US010184628B2

(12) United States Patent
Lin et al.

(10) Patent No.: US 10,184,628 B2
(45) Date of Patent: Jan. 22, 2019

(54) ELECTRONIC CANDLE WITH ELECTROMAGNETIC DRIVE UNIT

(71) Applicants: Mao-Lung Lin, New Taipei (TW); Lu-Kan Wang, Taipei (TW)

(72) Inventors: Mao-Lung Lin, New Taipei (TW); Lu-Kan Wang, Taipei (TW)

( * ) Notice: Subject to any disclaimer, the term of this patent is extended or adjusted under 35 U.S.C. 154(b) by 43 days.

(21) Appl. No.: 15/612,002

(22) Filed: Jun. 2, 2017

(65) Prior Publication Data

US 2018/0347772 A1 Dec. 6, 2018

(51) Int. Cl.

| | |
|---|---|
| ***F21L 4/00*** | (2006.01) |
| ***F21S 10/04*** | (2006.01) |
| ***F21S 6/00*** | (2006.01) |
| ***F21S 9/02*** | (2006.01) |
| ***F21V 23/04*** | (2006.01) |
| ***F21V 23/00*** | (2015.01) |
| ***H01F 7/06*** | (2006.01) |
| *F21Y 115/10* | (2016.01) |

(52) U.S. Cl.

CPC ..... *F21S 10/046* (2013.01); *F21S 6/001* (2013.01); *F21S 9/02* (2013.01); *F21V 23/003* (2013.01); *F21V 23/0407* (2013.01); *H01F 7/06* (2013.01); *F21Y 2115/10* (2016.08)

(58) Field of Classification Search

CPC . F21S 10/046; F21S 6/001; F21S 9/02; H01F 7/06; F21V 23/0407; F21V 23/003; F21Y 2115/10

See application file for complete search history.

(56) References Cited

U.S. PATENT DOCUMENTS

| | | | | |
|---|---|---|---|---|
| 9,322,524 | B1 * | 4/2016 | Lin | F21S 10/046 |
| 9,897,270 | B2 * | 2/2018 | Wu | F21S 10/04 |
| 2014/0169780 | A1 * | 6/2014 | Matsuki | G03B 11/00 396/508 |
| 2014/0218903 | A1 * | 8/2014 | Sheng | F21S 10/046 362/190 |
| 2015/0338086 | A1 * | 11/2015 | Patton | F21V 33/0052 362/96 |
| 2016/0312969 | A1 * | 10/2016 | Patton | F21S 6/001 |
| 2017/0023196 | A1 * | 1/2017 | Li | F21S 10/046 |

* cited by examiner

*Primary Examiner* — Tracie Y Green

(74) *Attorney, Agent, or Firm* — Juan Carlos A. Marquez; Marquez IP Law Office, PLLC

(57) ABSTRACT

An electronic candle with electromagnetic drive unit includes a casing, a wick assembly, a light source module, an electromagnetic drive unit, and a driving circuit. The casing has a top provided with an opening having a support, and the support is provided with an aperture. The wick assembly includes a wick element having a wick plate and a counterweight element which has a counterweight block. The counterweight block is combined with a magnet. The wick assembly swings freely by being supported by the support. The light source module projects light to the wick plate. The electromagnetic drive unit drives the magnet. The driving circuit electrically controls the light source module and the electromagnetic driving unit.

12 Claims, 8 Drawing Sheets

ELECTRONIC CANDLE WITH ELECTROMAGNETIC DRIVE UNIT

BACKGROUND OF THE INVENTION

1. Technical Field

The present invention relates to an electronic candle with electromagnetic drive unit and more particularly to an electronic candle with electromagnetic drive unit capable of simulating the swinging of a wick.

2. Description of Related Art

Electronic candles which are safe and convenient to use, energy-saving, and environmentally friendly have become more and more popular since their invention, especially in Europe and America, and people are gradually replacing the conventional cylindrical candles.

However, the existing electronic candles, though equipped with an electronic control circuit, are limited in function and unable to simulate the movement of a wick precisely. While some electronic candles have a timer function and can show color light, they lack a human touch in design and are disadvantaged by high power consumption, not to mention the poor wick simulation effect. All of the above have restricted the application of electronic candles.

BRIEF SUMMARY OF THE INVENTION

The present invention provides an electronic candle with electromagnetic drive unit featuring of structural simplicity, ease of use, and effectiveness in mimicking the swinging of a wick.

The present invention provides an electronic candle with electromagnetic drive unit, which includes a casing, a wick assembly, a light source module, an electromagnetic drive unit, and a driving circuit. The casing has a top provided with an opening, wherein the opening has an end internally provided with a support, and the support is provided with an aperture. The wick assembly comprises a wick element and a counterweight element, wherein the wick element has a wick plate, the wick plate has an end provided with the first connecting rod, the counterweight element has a counterweight block, the counterweight block has an end provided with a second connecting rod, and a magnet combined with a lower end of the counterweight block. Furthermore, the first connecting rod extends through the aperture and is connected with the second connecting rod in order for the wick assembly to swing freely by being supported by the support. The light source module is provided in an interior of an opposite end of the opening, wherein the light source module is arranged as to project light to the wick plate. The electromagnetic drive unit is disposed at a position where the magnetic field of the magnet acts to drive the magnet. The driving circuit electrically connects and controls the light source module and the electromagnetic driving unit.

The electronic candle with electromagnetic drive unit of the present invention uses a driving circuit to control the light-emitting state of a light source module. Therefore, the flashing light of the light source module is projected to a swing wick plate so as to enable the wick plate to simulate a freely swinging flame better.

The detailed features and advantages of the present invention will be described in detail with reference to the preferred embodiments so as to enable persons skilled in the art to gain insight into the technical disclosure of the present invention, implement the present invention accordingly, and readily understand the objectives and advantages of the present invention by perusal of the contents disclosed in the specification, the claims, and the accompanying drawings.

DETAILED DESCRIPTION OF THE INVENTION

Figure 1:
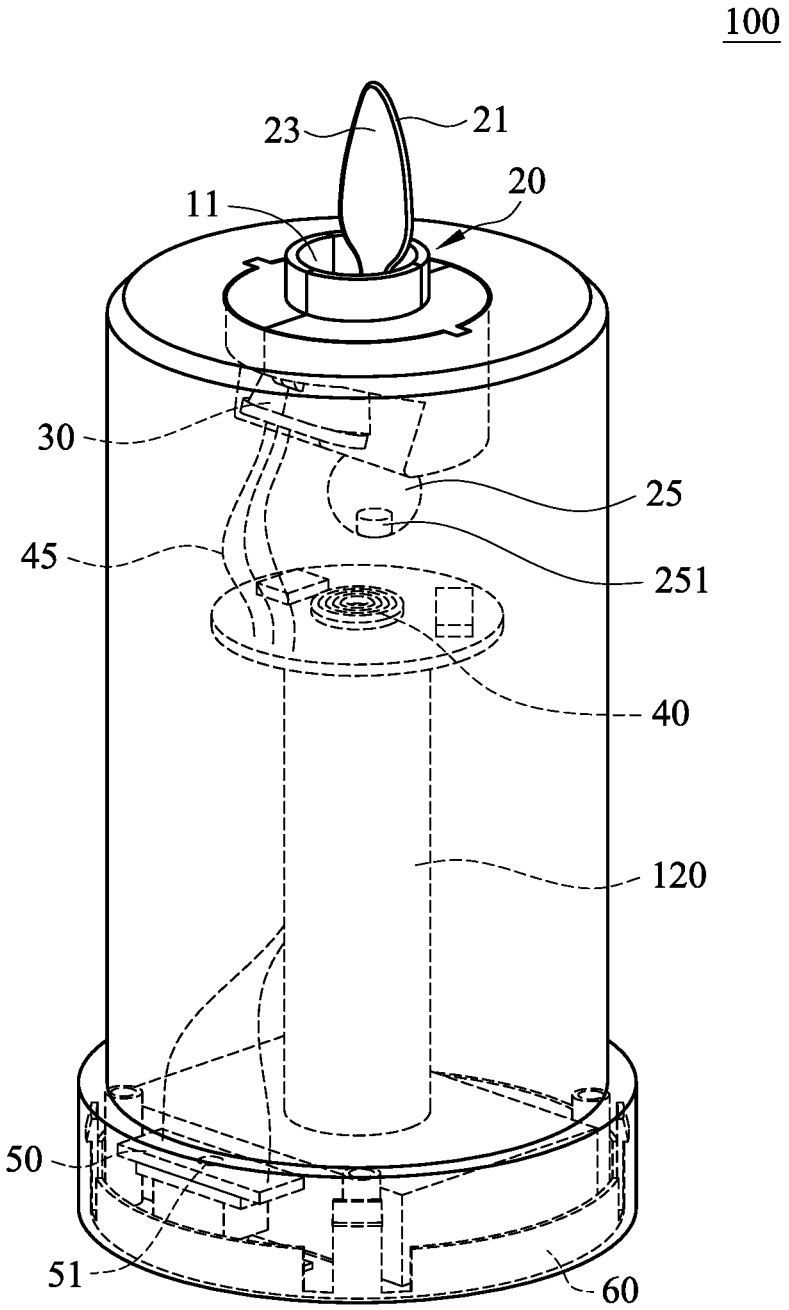
FIG. 1 is a schematic drawing showing an electronic candle with electromagnetic drive unit according to an embodiment of the present invention.
Figure 2:
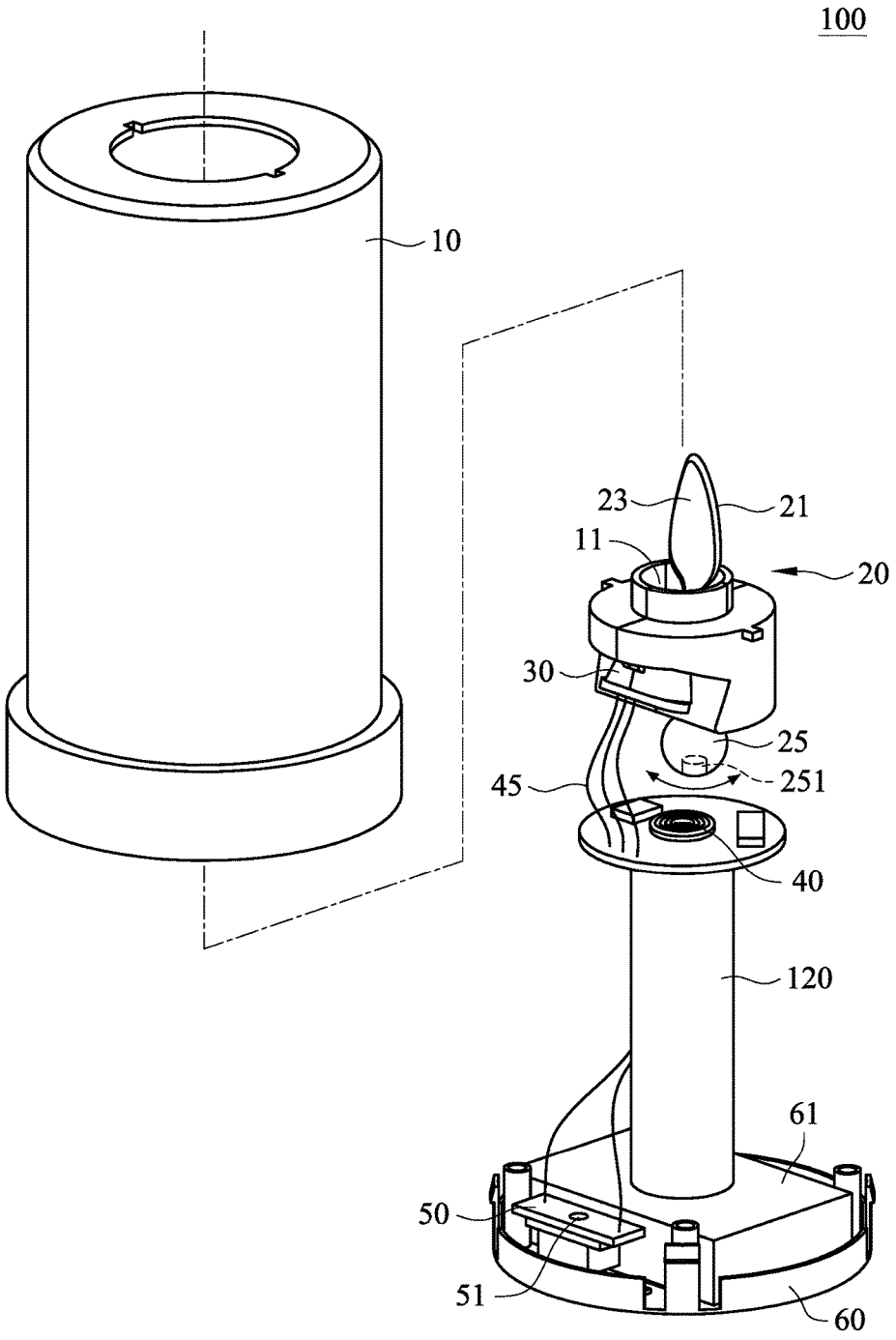
FIG. 2 is an exploded schematic drawing showing an electronic candle with electromagnetic drive unit according to an embodiment of the present invention.
Figure 3:
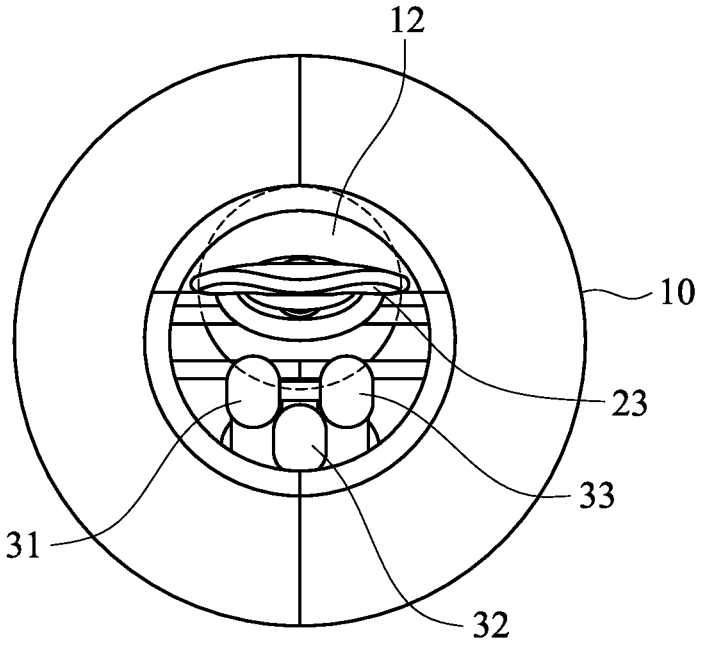
FIG. 3 is a schematic drawing showing a top view of the electronic candle with electromagnetic drive unit according to an embodiment of the present invention.
Figure 4:
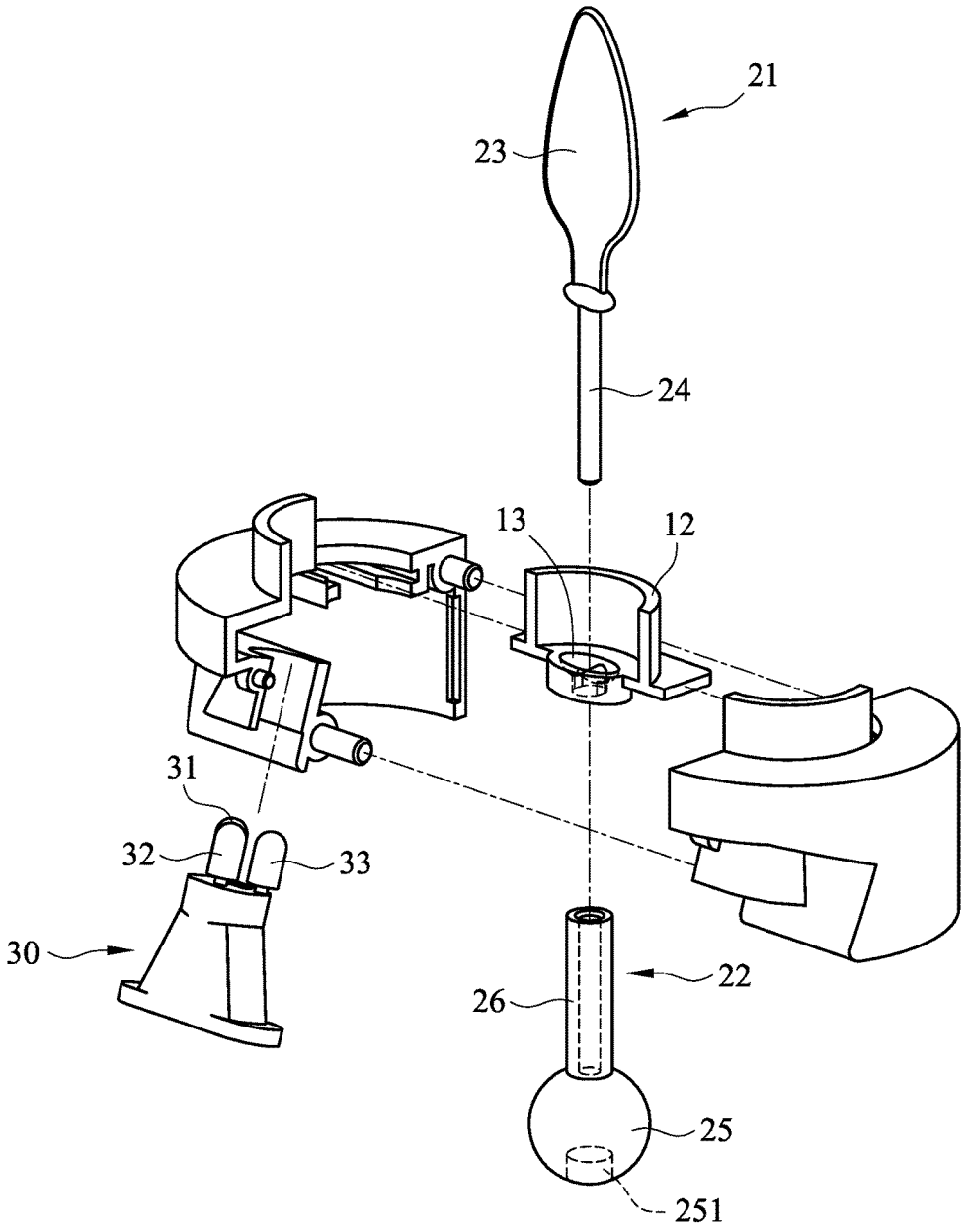
FIG. 4 is a schematic drawing showing a partial electronic candle with electromagnetic drive unit according to an embodiment of the present invention applied to the electronic candle with electromagnetic drive unit.

Please refer to FIG. 1 to FIG. 4. The electronic candle with electromagnetic drive unit 100 in this embodiment includes a casing 10, a wick assembly 20, a light source module 30, an electromagnetic drive unit 40, and a driving circuit 50.

The casing 10 is a hollow housing and is made of plastic for example. The top of the casing 10 has an opening 11 for receiving the wick assembly 20, wherein the opening 11 has one end internally provided with a support 12 for supporting the wick assembly 20. For connecting and supporting the wick assembly 20 conveniently and effectively, the support 12 is provided with an aperture 13.

The wick assembly 20 includes a wick element 21 and a counterweight element 22. The wick element 21 has a wick plate 23 shaped as a real flame and a first connecting rod 24 provided at one end of the wick plate 23. The counterweight element 22 has a counterweight block 25. One end of the counterweight block 25 is provided with a second connecting rod 26, and the lower end of the counterweight block 25 is combined with a magnet 251. The first connecting rod 24 extends through the aperture 13 and is connected with the second connecting rod 26 so that the wick assembly 20 can swing freely by being supported by the support 12.

The light source module 30 is provided in the interior of the other end of the opening 11 and is composed of three LEDs 31, 32, 33 arranged in such a way that the light emitted by the light source module 30 is projected to the wick plate 23. In this embodiment, the LEDs 31, 32, and 33 are arranged in a triangle so as to project light to the wick plate 23.

Figure 5:
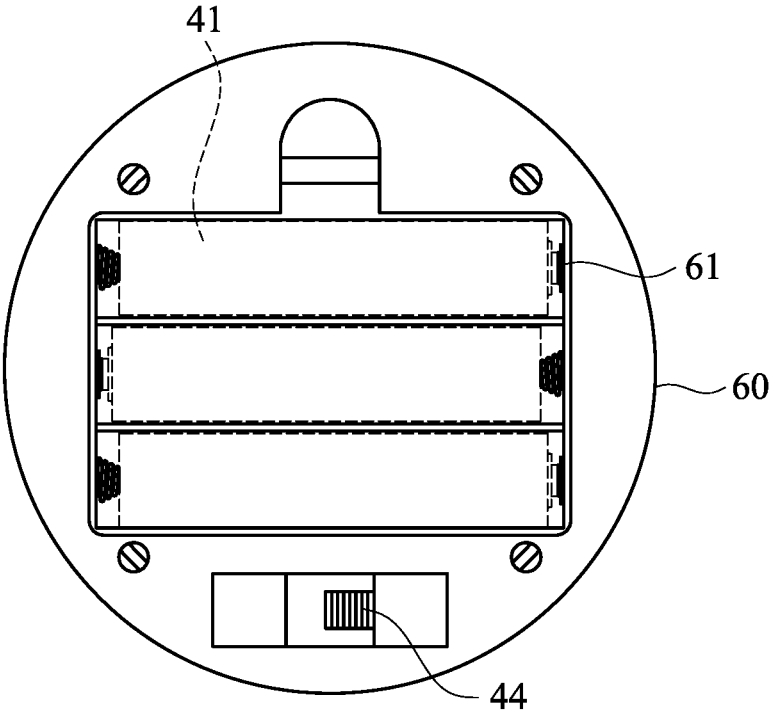
FIG. 5 is a schematic drawing showing a battery box according to an embodiment of the present invention applied to the electronic candle with electromagnetic drive unit.

Please refer to FIG. 1 and FIG. 5. The electronic candle with electromagnetic drive unit 100 further includes a base 60 at the lower end of the casing 10, and the base 60 also has a battery box 61. The electronic candle with electromagnetic drive unit 100 also includes a power supply 41 in the battery box 61 and a driving circuit 50 in the casing 10. The power supply 41 is preferably provided in a lower portion of the base 60 and is electrically connected to the driving circuit 50 so as to supply power to the driving circuit 50.

The electromagnetic drive unit 40 may be a coil which is disposed at a position where the magnetic field of the magnet acts to drive the magnet 251. The wick assembly 20 swings by the magnet 251 which is driven by the electromagnetic drive unit 40, and the wick plate 23 collects light for the light source module 30. Therefore, the electronic candle with electromagnetic drive unit 100 can become a simulation candle. In order to stabilize the electromagnetic drive unit 40, it may be fixed on a pillar 120.

The driving circuit 50 also can be provided in an upper portion of the base 60 and is electrically connected to the light source module 30 through a wire 45 in order to drive the LEDs 31, 32, and 33 into a flashing state. The driving circuit 50 is also electrically connected to the electromagnetic drive unit 40 in order to drive the magnet 251, and then the wick assembly 20 is swung.

Figure 6A:
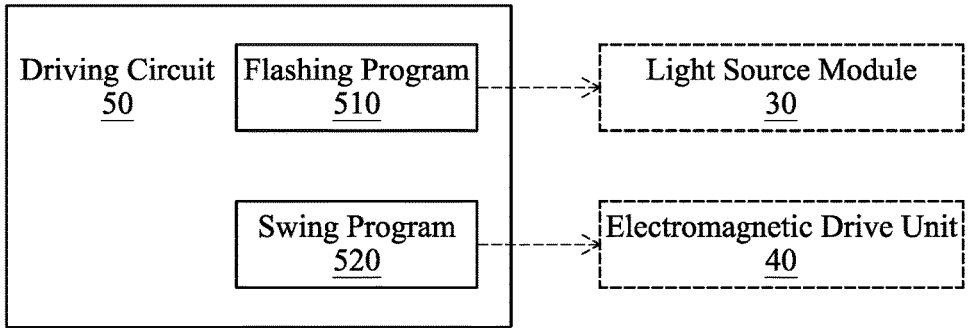
FIG. 6A is a block diagram of a driving circuit.
Figure 6B:
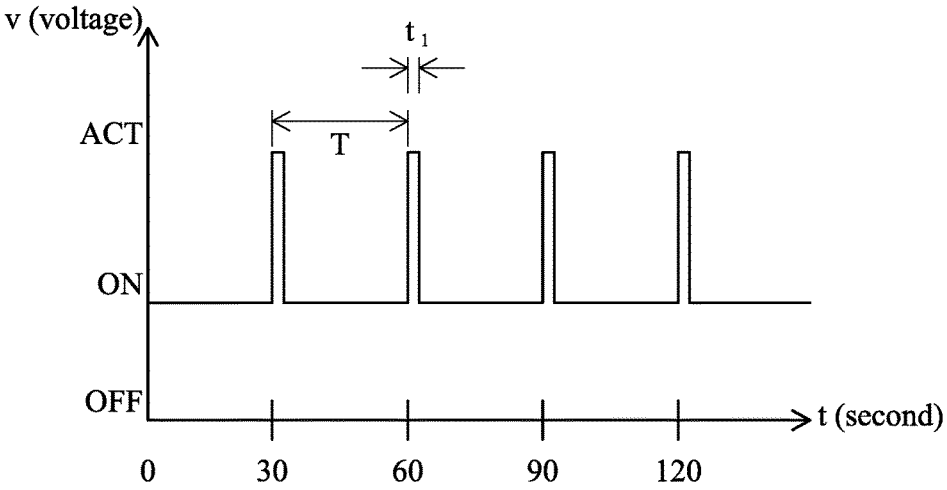
FIG. 6B is a control wave generated by a wing program.

Please refer to FIG. 6A and FIG. 6B. The driving circuit 50 is a MCU (microcontroller unit), which is configured to execute a flashing program 510 to instruct the light source module 30 to light up in a flashing manner, and is configured to execute a swing program 520 to generate a control wave to instruct the electromagnetic drive unit 40 to drive the magnet 251 in an intermittent manner, wherein the control wave is a pulse wave whose period T is 30±5 seconds and the pulse width t1 is 0.3±0.1 seconds. By combining the flashing program 510 with the swing program 520, the wick assembly 20 can show better visual effects for simulating flame swing.

The electronic candle with electromagnetic drive unit 100 includes a switch 44 provided in a lower portion of the base 60 and electrically connected to the power supply 41 so as to turn on and off the power supply 41.

Figure 7:
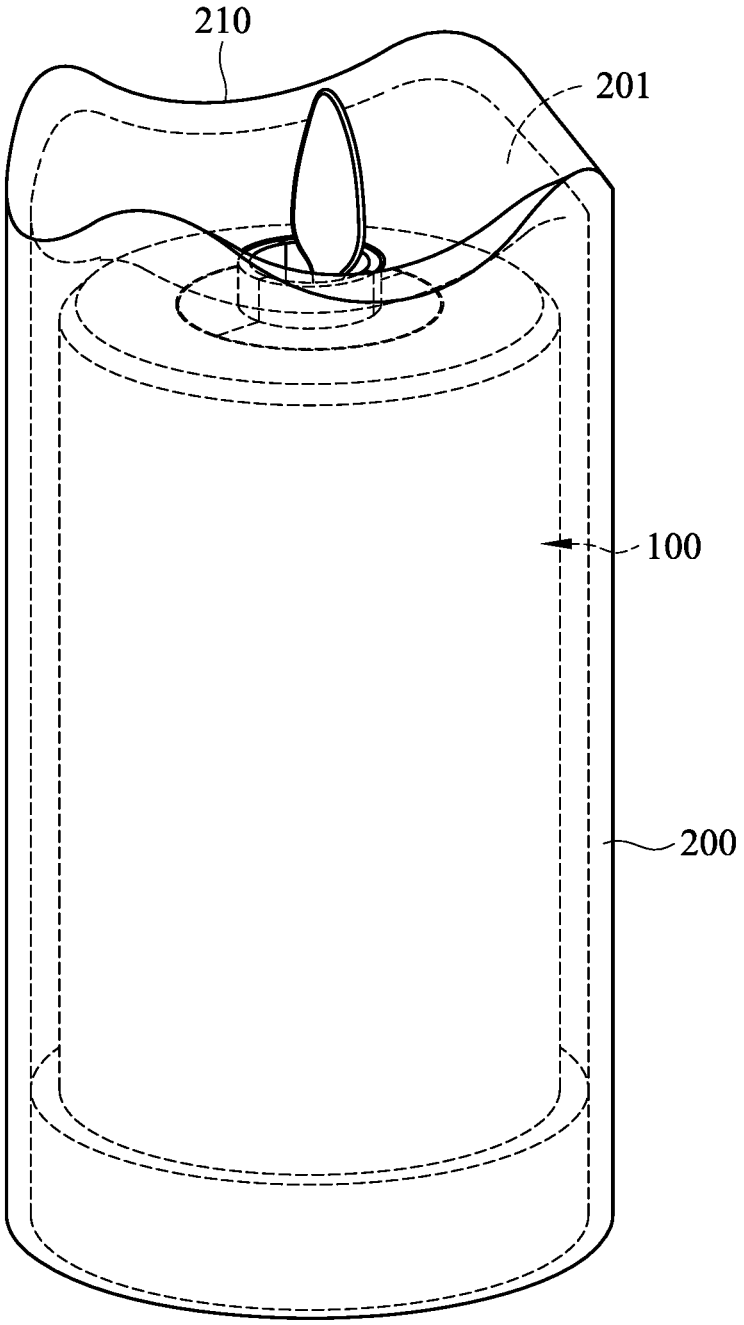
FIG. 7 is an exploded schematic drawing showing an electronic candle with electromagnetic drive unit having candle housing according to an embodiment of the present invention.
Figure 8:
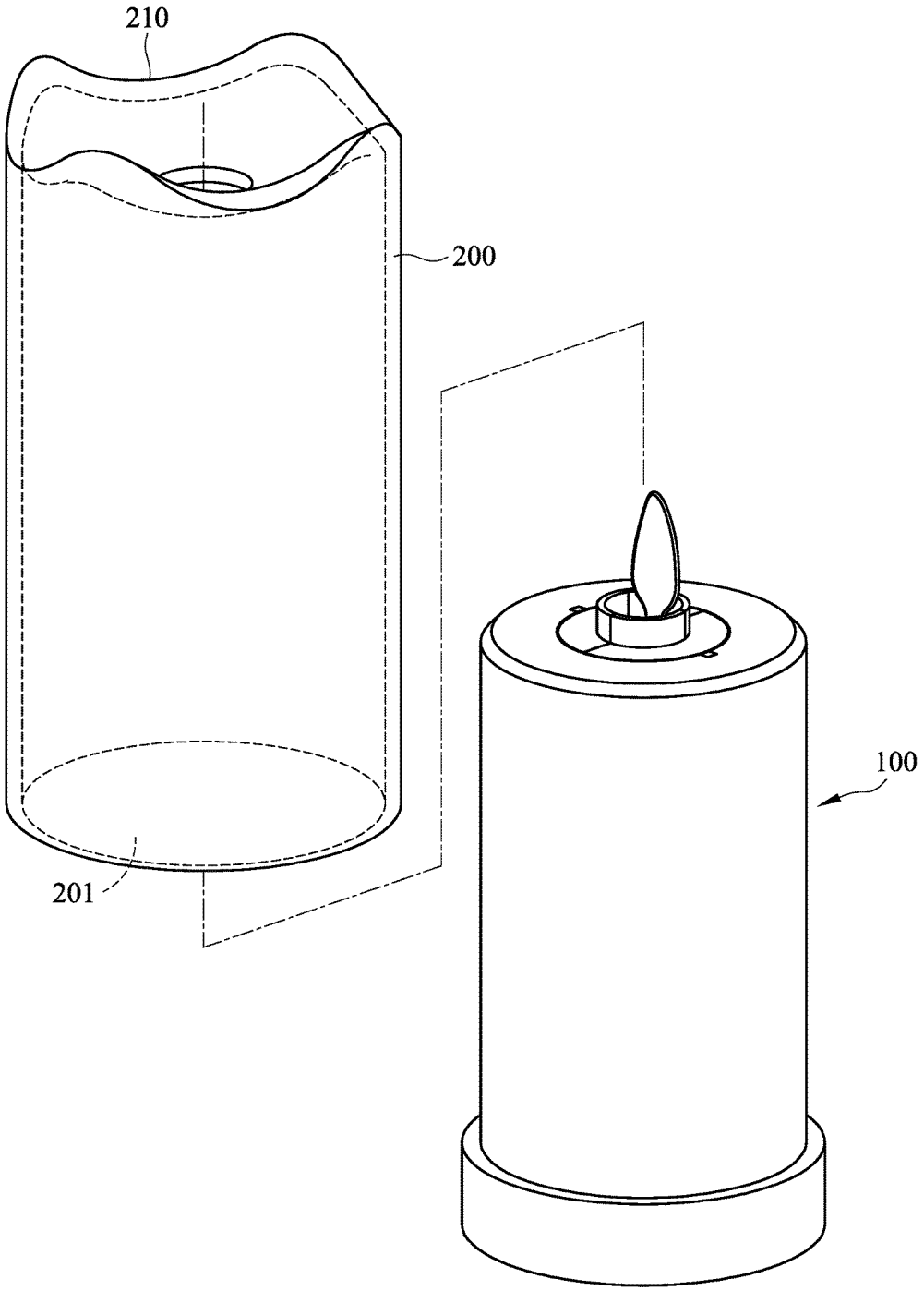
FIG. 8 is a schematic drawing showing an electronic candle with electromagnetic drive unit having candle housing according to an embodiment of the present invention.

FIG. 7 and FIG. 8 show how the electronic candle with electromagnetic drive unit in the foregoing embodiment can be used. In order for the electronic candle with electromagnetic drive unit 100 to resemble as a conventional candle in appearance, the electronic candle with electromagnetic drive unit 100 further includes a candle housing 200. The candle housing 200 has a hollow space 201 for receiving the casing 10 and mimicking the look of a conventional candle. The candle housing 200 can be made of clear glass, paraffin, plastic, or resin. In addition, the top of the candle housing 200 is formed with a curved structure 210.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. An electronic candle with electromagnetic drive unit, comprising:

a casing having a top provided with an opening, wherein the opening has an end internally provided with a support, and the support is provided with an aperture;

a wick assembly comprising a wick element and a counterweight element, wherein the wick element has a wick plate, the wick plate has an end provided with a first connecting rod, the counterweight element has a counterweight block, the counterweight block has an end provided with a second connecting rod, and a magnet is combined with a lower end of the counterweight block, wherein the first connecting rod extends through the aperture and is connected with the second connecting rod in order for the wick assembly to swing freely by being supported by the support;

a light source module provided in an interior of an opposite end of the opening, wherein the light source module is arranged as to project light to the wick plate;

an electromagnetic drive unit disposed at a position where the magnetic field of the magnet acts to drive the magnet; and a driving circuit configured to execute a flashing program to instruct the light source module to light up in a flashing manner and configured to execute a swing program to generate a control wave to instruct the electromagnetic drive unit to drive the magnet in an intermittent manner;

wherein the control wave is a pulse wave whose period is 30±5 seconds and the pulse width is 0.3±0.1 seconds.

2. The electronic candle with electromagnetic drive unit of claim 1, wherein the casing is made of plastic.

3. The electronic candle with electromagnetic drive unit of claim 1, further comprising a base provided at a lower end of the casing.

4. The electronic candle with electromagnetic drive unit of claim 3, wherein the base further has a battery box.

5. The electronic candle with electromagnetic drive unit of claim 1, wherein the electromagnetic drive unit is a coil.

6. The electronic candle with electromagnetic drive unit of claim 1, wherein the electromagnetic drive unit is fixed on a pillar.

7. The electronic candle with electromagnetic drive unit of claim 1, wherein the light source module has at least three LEDs.

8. The electronic candle with electromagnetic drive unit of claim 7, wherein the driving circuit is for executing a flashing program and controlling a flashing behavior of the at least three LEDs.

9. The electronic candle with electromagnetic drive unit of claim 7, wherein the driving circuit further comprises a controller for executing a swing program and controlling a magnetic forcing behavior of the electromagnetic drive unit.

10. The electronic candle with electromagnetic drive unit of claim 1, further comprising a candle housing, wherein the candle housing has a hollow space for receiving the casing.

11. The electronic candle with electromagnetic drive unit of claim 10, wherein the candle housing is made of clear glass, paraffin, plastic, or resin.

12. The electronic candle with electromagnetic drive unit of claim 10, wherein a top of the candle housing is formed with a curved structure.

* * * * *